US008689506B2

(12) United States Patent
Fornatora et al.

(10) Patent No.: US 8,689,506 B2
(45) Date of Patent: Apr. 8, 2014

(54) MOISTURE BARRIER WALL

(76) Inventors: Amil Fornatora, Scottsdale, AZ (US); Philip Coppola, Fountain Hills, AZ (US)

( * ) Notice: Subject to any disclaimer, the term of this patent is extended or adjusted under 35 U.S.C. 154(b) by 596 days.

(21) Appl. No.: 12/626,144

(22) Filed: Nov. 25, 2009

(65) Prior Publication Data

US 2011/0120028 A1 May 26, 2011

(51) Int. Cl.
*E02D 27/32* (2006.01)

(52) U.S. Cl.
USPC ..... 52/294; 52/169.14; 52/274; 52/414

(58) Field of Classification Search
USPC ..... 52/169.1, 169.2, 169.9, 169.13, 169.14, 52/274, 292, 294, 414, 741.3; 405/262, 55
See application file for complete search history.

(56) References Cited

U.S. PATENT DOCUMENTS

| | | | | |
|---|---|---|---|---|
| 1,728,736 | A * | 9/1929 | Shergold | 52/167.1 |
| 1,746,918 | A * | 2/1930 | Webster | 52/293.1 |
| 3,269,126 | A | 8/1966 | Freeman | |
| 3,543,459 | A * | 12/1970 | Mills | 52/169.11 |
| 4,015,432 | A | 4/1977 | Ball | |
| 4,508,472 | A | 4/1985 | Handy et al. | |
| 4,534,143 | A * | 8/1985 | Goines et al. | 52/169.5 |
| 5,674,929 | A * | 10/1997 | Melbye | 524/377 |
| 5,924,251 | A | 7/1999 | Jalla | |
| 5,934,036 | A * | 8/1999 | Gallagher, Jr. | 52/323 |
| 5,953,864 | A * | 9/1999 | Beck | 52/127.11 |
| 6,237,291 | B1 * | 5/2001 | Elwart | 52/250 |
| 7,003,918 | B2 | 2/2006 | Williams | |
| 7,010,891 | B1 * | 3/2006 | Clark et al. | 52/283 |
| 7,131,239 | B2 | 11/2006 | Williams | |
| 2003/0188496 | A1 | 10/2003 | Williams | |
| 2003/0233798 | A1 | 12/2003 | Berkey et al. | |
| 2007/0269273 | A1 * | 11/2007 | Henderson | 405/239 |
| 2008/0292410 | A1 * | 11/2008 | Brown | 405/231 |
| 2008/0304919 | A1 | 12/2008 | Coyle | |

FOREIGN PATENT DOCUMENTS

| | | | |
|---|---|---|---|
| WO | W02005021874 | A2 | 3/2005 |

* cited by examiner

*Primary Examiner* — Branon Painter
(74) *Attorney, Agent, or Firm* — Venable, Campillo, Logan & Meaney, P.C.

(57) ABSTRACT

A foundation system is disclosed that is used when building a structure on expansive soils. The foundation system includes a vertical wall that prevents moisture from migrating beyond the vertical wall into the zone of influence under the foundation. The prevention of the moisture migration into the zone of influence precludes damage to the foundation and structure caused by expansive soils.

27 Claims, 6 Drawing Sheets

MOISTURE BARRIER WALL

FIELD OF THE INVENTION

The present invention relates generally to structural foundations, and more particularly to a vertical wall that prevents moisture from migrating into the zone of influence of the soil under a foundation of a residential or commercial building built in expansive soil areas.

BACKGROUND OF THE INVENTION

Several techniques have been used in the past to solve structural problems caused when buildings are built on expansive soils which shrink and swell with moisture. Specifically, below-grade barriers can be installed after construction and after distress manifests itself in a building. These after the fact barriers are very expensive and intrusive. Moreover, these barriers are placed several feet beyond the existing building slab or footing thereby necessitating an additional barrier to prevent moisture from migrating between the below-grade barrier and the existing building slab or footing. Repairs after the fact are extremely costly depending on the amount of damage associated with the foundation movement due to the expansive soil below. Other similar barriers used to repair damage after the fact include cutoff walls of concrete or synthetic membranes.

The use of after the fact remedial approaches to repair damages to structures caused by expansive soils is more costly and time consuming than installing a vertical wall to prevent moisture seepage at the time of initial construction. With after the fact remedial procedures, landscaping is destroyed, mechanical units are relocated, patios and driveways are torn up, and owners and occupants of the property are displaced for weeks at a time to allow time for the repairs.

In the prior art methods, post-tensioned concrete slabs have been used to deal with expansive soils. This type of construction, however, is expensive and requires extensive engineering and specialized construction techniques. Additionally, the floor plan designs are limited due to the constraints inherent in post-tensioned slabs. The current invention eliminates these constraints, is simple to install and will prevent the distress in buildings caused by foundation movement associated with both expansive and collapsible soils. Therefore, it is desirable to have a vertical wall that extends into the soil and is integral with the building foundation in order to prevent moisture from migrating into the zone of influence under the building foundation.

Various techniques have been disclosed in U.S. Pat. No. 4,015,432 (H F Ball), U.S. Pat. No. 4,534,143 (Goines et al.), U.S. Pat. No. 5,924,251 (Jalla), U.S. Pat. No. 4,508,472 (Handy), U.S. Pat. No. 3,269,126 (Freeman), U.S. Pat. No. 1,746,918 (Webster), U.S. Pat. No. 7,131,239 (Williams), U.S. Pat. No. 7,003,918 (Williams), U.S. Patent Application Nos. 20080304919 (Coyle), 20030233798 (Berkey et al.), 20030188496 (Williams), and International Publication No. WO 2005021874 (Bashford) to overcome the problems with building on expansive soils. However, these disclosures suffer from one or more of the following disadvantages. First, none of these inventions include a vertical wall that extends deep below the surface of the soil and is integral with the building foundation. Second, none of these inventions are simple and inexpensive designs. Third, most of the inventions above are remedial in nature rather than including a design that prevents foundation problems at the time of initial construction.

SUMMARY OF THE INVENTION

A structural foundation for use in expansive or other soil comprises a foundational element. The foundational element is made of a vertical wall and a slab on a soil surface. The vertical wall is poured integral to the slab and the top of the vertical wall contacts the foundation. The bottom of the vertical wall extends a distance below the soil surface and prevents moisture from migrating beyond the vertical wall under the foundational element.

In an alternate embodiment, a foundation appurtenance for use in expansive soils comprises a vertical wall and a foundation. The foundation further comprises a slab on a soil surface and a footing below the soil surface. The vertical wall is poured integral to the footing and the top of the vertical wall contacts the footing. The bottom of the vertical wall extends a distance below the soil surface and prevents moisture from migrating beyond the vertical wall under the foundation.

The present invention is directed to a foundation used in expansive soils to prevent water migration beyond a vertical wall into a zone of influence under a building foundation.

It is a further object of the present invention to provide a foundation with a vertical wall that is poured integral with the foundation.

It is a further object of the present invention to provide a foundation with a vertical wall that is installed at the time of initial construction.

The novel features that are considered characteristic of the invention are set forth with particularity in the appended claims. The invention itself, however, both as to its structure and its operation together with the additional object and advantages thereof will best be understood from the following description of the preferred embodiment of the invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6 are sought to be invoked to define the invention (s), the claims will specifically state the phrases "means for" or "step for" and a function, without also reciting in such phrases any structure, material, or act in support of the function.

Moreover, even if the provisions of 35 U.S.C. §112, paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later developed equivalent structures, materials, or acts for performing the claimed function.

DESCRIPTION OF PREFERRED EMBODIMENTS

Figure 5:
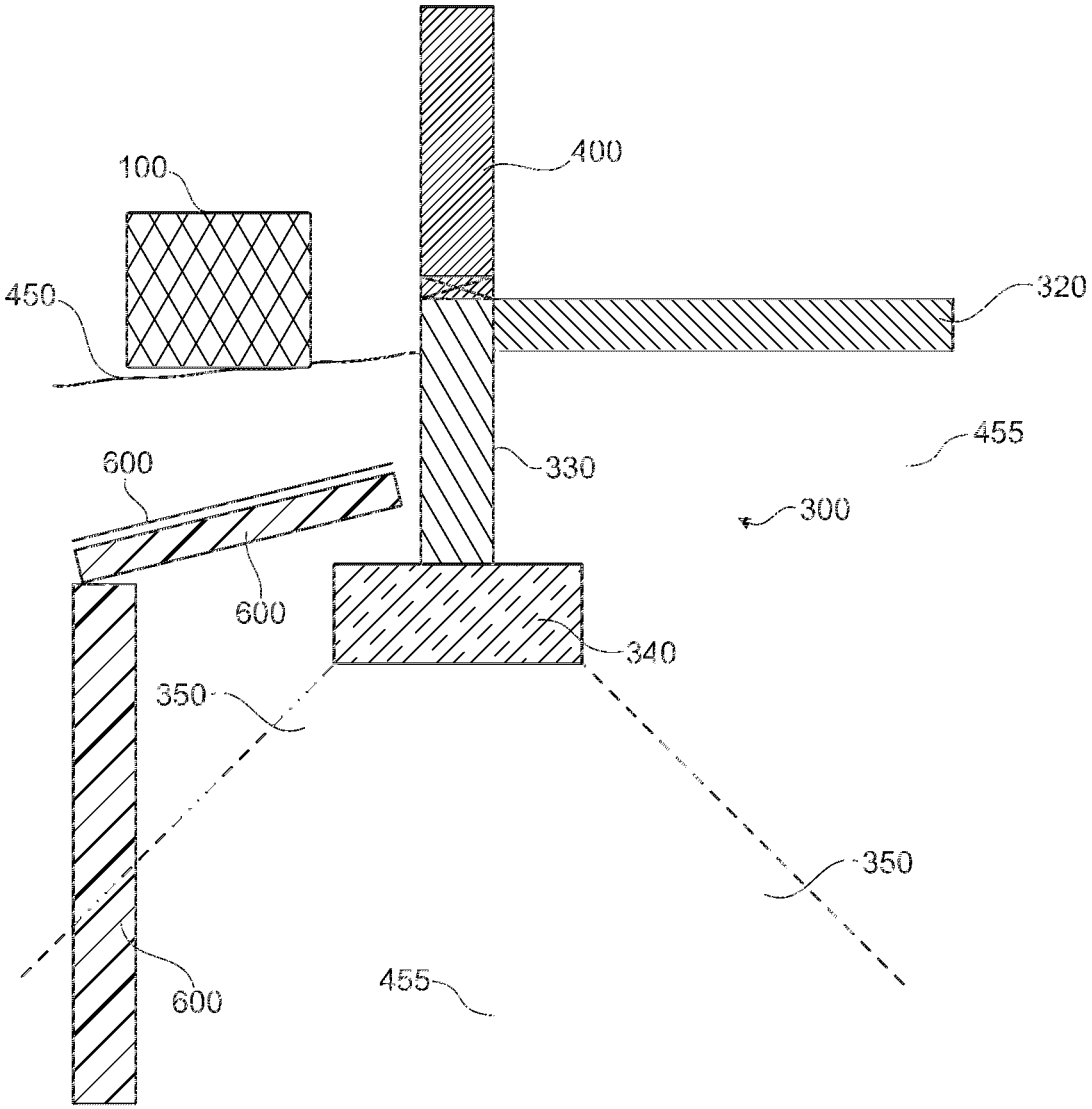
Fig. 5 (Prior Art)
FIG. 5 shows a prior art design of a remedial apparatus to repair foundation damage due to migration of water into an expansive soil under the foundation.

As described above, several techniques have been used in the past to solve structural problems caused when buildings are built on expansive soils 455 which shrink and swell with moisture. FIG. 5 shows one of the prior art methods. Specifically, FIG. 5 shows a foundation 300 that includes a slab 320, a stem 330, and a footing 340. Shown under the footing 340 is the zone of influence 350 which is the area of soil where with the introduction of moisture the soil could expand and cause the foundation 300 of a structure 400 built on the foundation 300 to move. The zone of influence 350 is defined based on the angle of repose. More specifically, the zone of influence is the area of soil that is located below the footing of the foundation and extends 45° on either side of the footing. When moisture enters the zone of influence 350, the moisture can cause the soil to move and in turn can cause the foundation 300 to shift damaging the structure 400 built on the foundation 300. To remedy the damage that has already occurred because of the migration of moisture into the zone of influence 350, the prior art shows at least one cut off wall 600 that is placed a distance away from the foundation 300. These remedial cut off walls 600 are intended to prevent further moisture from entering into the zone of influence 350 and causing more damage to the foundation 300 and structure 400. As seen in FIG. 5, however, the remedial cut off walls 600 are placed away from the foundation 300 allowing moisture to continue entering the zone of influence 350. Moreover, because the cut off walls 600 are installed after the structure has been built and the landscaping installed, plants and mechanical equipment 100 must be moved causing more expense and time.

In contrast, the preferred embodiments of the present invention shown in FIGS. 1A, 1B, 2, 3, and 4 show how a vertical wall 200 is poured integrally with the foundation 300 at the time of initial construction so that moisture is prevented from entering the zone of influence 350 and causing damage. There are several embodiments of the invention depending on the type of soil and the elevation at which the foundation 300 and structure 400 will be constructed.

Figure 1A:
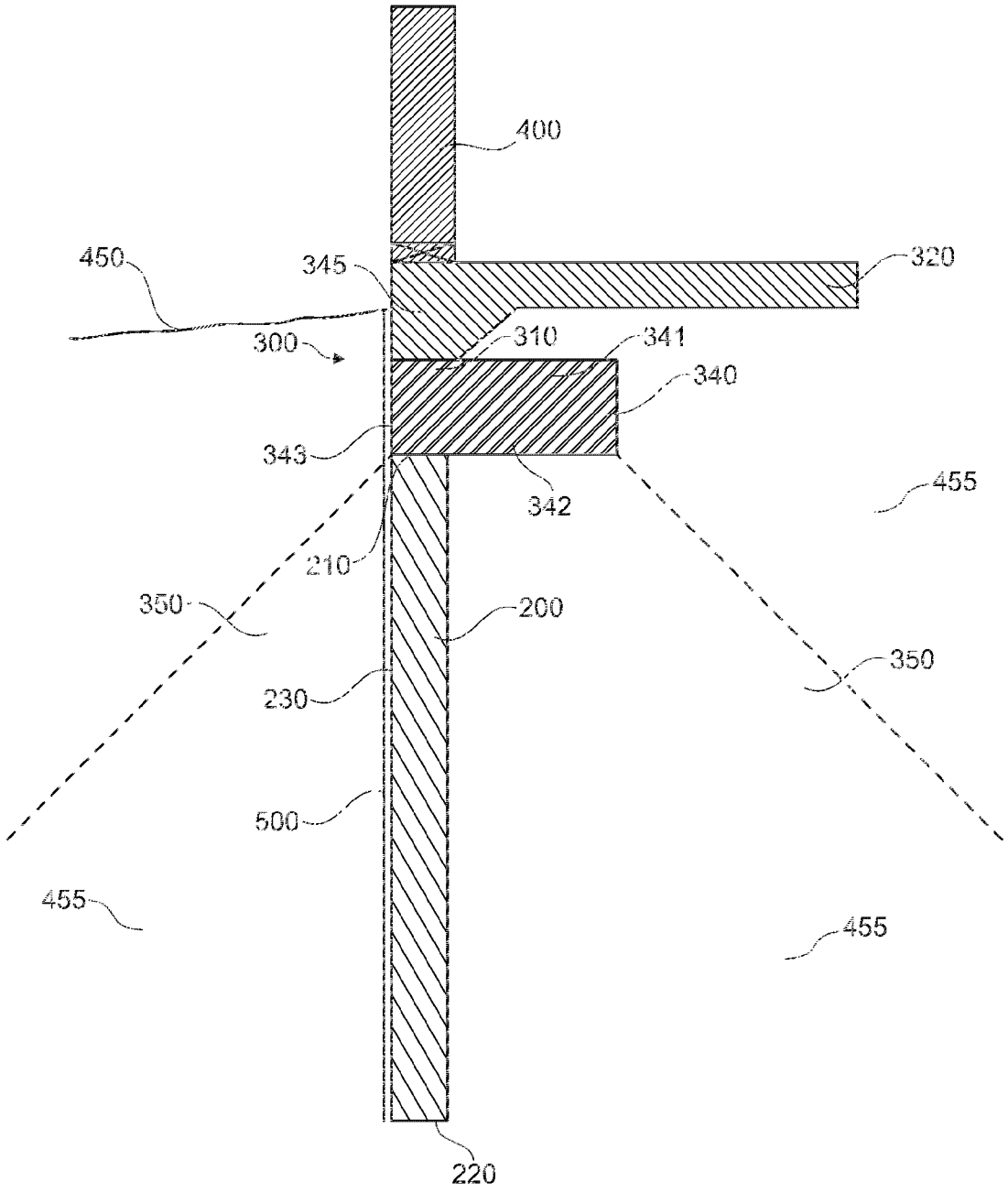
FIG. 1A shows a preferred embodiment of the invention where the vertical wall is an appurtenance to the foundation and is located below a footing and a slab.
Figure 1B:
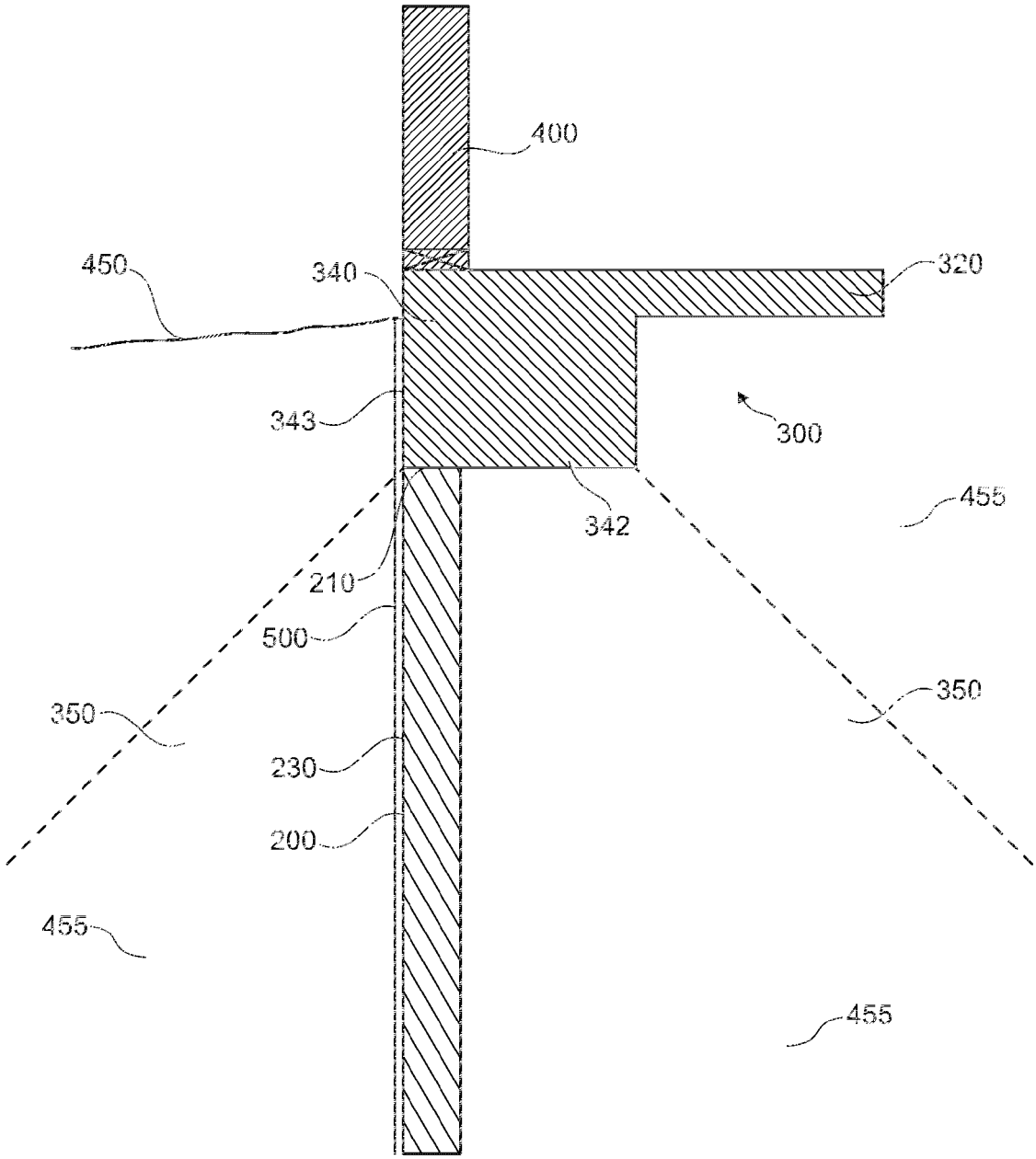
FIG. 1B shows a preferred embodiment of the invention where the vertical wall is an appurtenance to the foundation and is located below the footing and slab wherein the footing and slab are poured as a monolithic piece.
Figure 3:
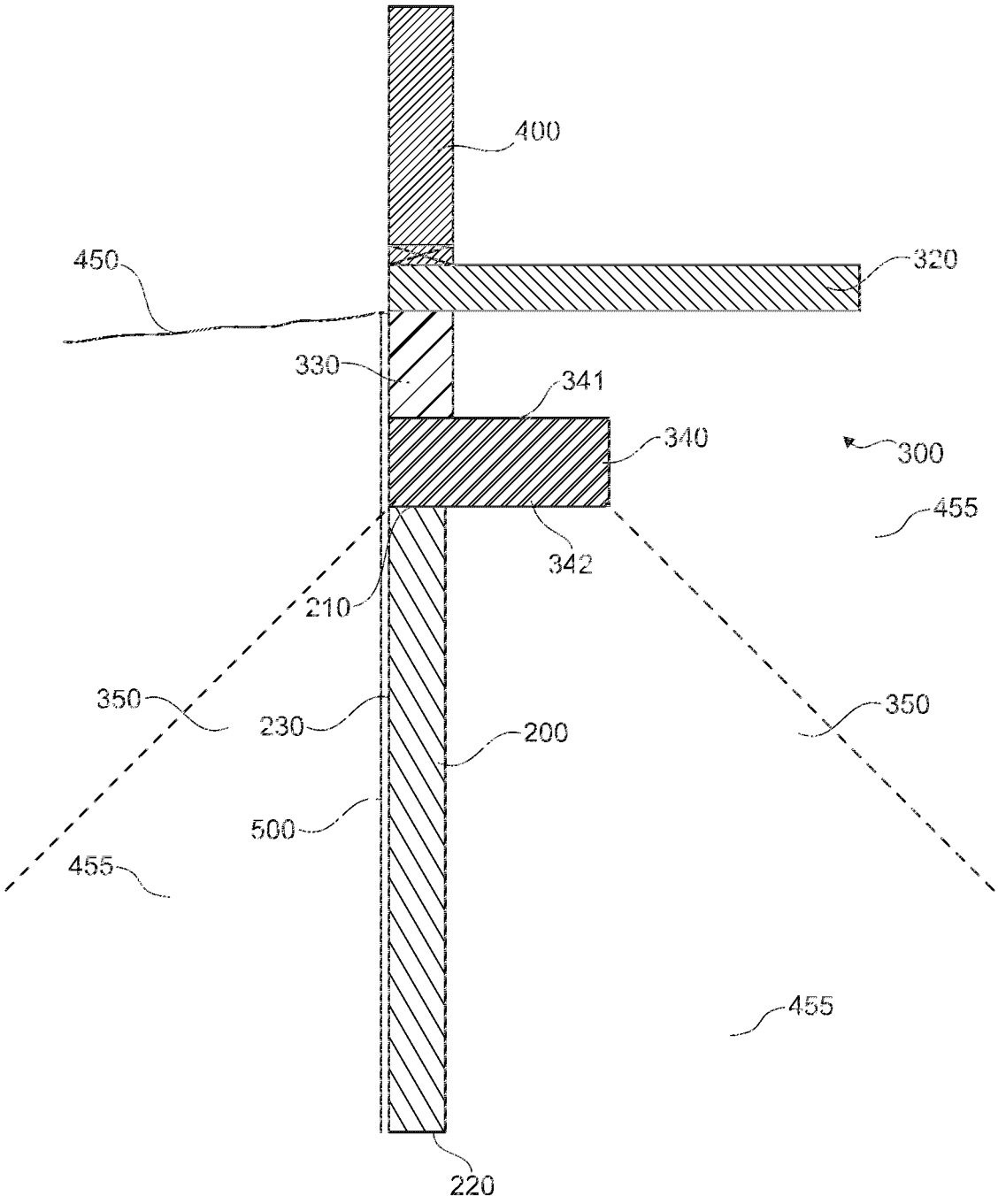
FIG. 3 shows a preferred embodiment of the invention where the vertical wall is an appurtenance to the foundation and is located below the slab, stem, and footing.

FIGS. 1A, 1B, and 3 show an embodiment of the current invention where the vertical wall 200 is an appurtenance to the foundation 300 rather than a structural element of the foundation 300. This embodiment is preferred at elevations of 0-8,000 feet above sea level. More specifically, FIGS. 1A and 1B show the preferred embodiment for elevations 0-3,000 feet above sea level and FIG. 3 shows the preferred embodiment for elevations 3,000-8,000 feet above sea level.

In FIGS. 1A and 1B, a foundation system 300 is shown that includes a slab 320 and a footing 340. In FIG. 1A the slab 320 and footing 340 are poured as two separate pieces where the slab 320 has a turndown edge 345 that contacts the footing 340. In this embodiment, the topside 341 of the footing 340 contacts the underside 310 of the slab 320, and the footing 340 and slab 320 work together as the structural foundational support for a structure 400 built on the foundation 300. The structure 400 may be conventional wood framing, masonry, and steel studs. Underneath the footing 340 is the vertical wall 200 where the top 210 of the vertical wall 200 contacts the underside 342 of the footing 340.

In the current invention, the vertical wall 200 acts to prevent moisture from migrating through the expansive soil 455 into the zone of influence 350. As explained above, the zone of influence 350 is the area of soil that when introduced with moisture could cause the foundation 300 to move and damage the structure 400.

The depth of the slab 320 and footing 340 below the soil surface 450 depends on the elevation above sea level of the area where the structure 400 is being built. In the embodiment shown in FIG. 1A, the elevation of the area is 0-3,000 feet above sea level, and the depth of the slab 320 and the footing 340 is preferably 12 inches below finished grade or the soil surface 450. Because the vertical wall 200 contacts the underside 342 of the footing 340 this 12 inch depth is also the depth at which the top 210 of the vertical wall 200 is below the soil surface 450.

The vertical wall 200 extends a distance below the footing 340 such that moisture is prevented from migrating beyond the vertical wall 200 into the zone of influence 350 under the foundation 300. In the preferred embodiment shown in FIG. 1A, the vertical wall 200 extends a minimum of 3 feet 6 inches from the top 210 of the vertical wall 200 that contacts the underside 342 of the footing 340 to the bottom 220 of the vertical wall 200. In other words, the bottom 220 of the vertical wall 200 is a minimum depth of 4 feet 6 inches below the soil surface 450. It is preferred that the vertical wall 200 is 4 inches wide.

To create the foundation 300 shown in the preferred embodiment of FIG. 1A, the area where the footing 340 will be poured is first excavated. A trencher is then used to dig a 4 inch wide excavation in line with the outer edge 343 of the footing 340 a minimum of 3 feet 6 inches below the excavation of the footing 340 as described above. This 3 foot 6 inch depth can vary, however, depending on the exact make up of the soil. The trenched area is then cleaned and the 4 inch wide excavation is filled with concrete to create the vertical wall 200. Preferably, the excavation is filled with a ½ sack mix of concrete. Alternatively, however, the excavation could be filled with a grout mix, or any other material with similar properties. In this embodiment, no additional steel reinforcement is needed because, as stated above, the vertical wall 200 is not part of the structural foundation but rather an appurtenance to the foundation 300. As such, the vertical wall 200 does not support the structure 400 so no reinforcement is needed. Once the vertical wall 200 is poured, the footing 340 is then poured with the proper concrete and steel reinforcements. In an alternate embodiment, the vertical wall 200 can be poured monolithically with the footing 340 such that the vertical wall 200 and footing 340 are one piece. Pouring the two pieces together saves time in construction. Additionally, depending upon the conditions, a waterproofing additive may be added to the vertical wall 200 such that it is impervious to water.

Moreover, if it is determined that the soil 455 where the foundation 300 and structure 400 are being built has a swell potential greater than 2%, a liner 500 is placed on the outside edge 230 of the vertical wall 200 that faces away from the slab 320. The liner 500 provides slippage of the vertical wall 200 in the soil 455 thereby eliminating friction that could cause the entire foundation 300 to move, thus causing damage to the structure 400. It is preferred that the liner 500 is made of high density polyethylene with a thickness of 15-40 millimeters, but any material with similar properties can be used.

In the embodiment shown in FIG. 1B, the slab 320 and footing 340 are poured as one monolithic piece. Here, the footing 340 and slab 320 work together as the structural foundational support for a structure 400 built on the foundation 300. The structure 400 may be conventional wood framing, masonry, and steel studs. Underneath the footing 340 is the vertical wall 200 where the top 210 of the vertical wall 200 contacts the underside 342 of the footing 340 piece.

In this embodiment of the current invention, the vertical wall 200 acts to prevent moisture from migrating through the expansive soil 455 into the zone of influence 350. As explained above, the zone of influence 350 is the area of soil that when introduced with moisture could cause the foundation 300 to move and damage the structure 400.

In this embodiment, the depth of the slab 320 and footing 340 below the soil surface 450 depends on the elevation above sea level of the area where the structure 400 is being built. In the embodiment shown in FIG. 1B, the elevation of the area is 0-3,000 feet above sea level, and the depth of the footing 340 is 12 inches below finished grade or the soil surface 450. Because the vertical wall 200 contacts the underside 342 of the footing 340, this 12 inch depth is also the depth at which the top 210 of the vertical wall 200 is below the soil surface 450.

The vertical wall 200 extends a distance below the footing 340 such that moisture is prevented from migrating beyond the vertical wall 200 into the zone of influence 350 under the foundation 300. In the preferred embodiment shown in FIG. 1B, the vertical wall 200 extends 3 feet 6 inches from the top 210 of the vertical wall 200 that contacts the underside 342 of the footing 340 to the bottom 220 of the vertical wall 200. This means that the bottom 220 of the vertical wall 200 is a depth of 4 feet 6 inches below the soil surface 450. It is preferred that the vertical wall 200 is 4 inches wide.

To create the foundation 300 shown In the preferred embodiment of FIG. 1B, the area where the footing 340 will be poured is first excavated. A trencher is then used to dig a 4 inch wide excavation in line with the outer edge 343 of the footing 340 a minimum of 3 feet 6 inches below the footing 340 as described above. This 3 foot 6 inch depth can vary, however, depending on the exact make up of the soil 455. The trenched area is then cleaned and the 4 inch wide excavation is filled with concrete to create the vertical wall 200. Preferably, the excavation is filled with a ½ sack mix of concrete. Alternatively, however, the excavation could be filled with a grout mix. In this embodiment, no additional steel reinforcement is needed because, as stated above, the vertical wall 200 is not part of the structural foundation but rather an appurtenance to the foundation 300. As such, the vertical wall 200 does not support the structure 400 so no reinforcement is needed. Once the vertical wall 200 is poured, the footing 340 and slab 320 are then poured with the proper concrete and steel reinforcements. In an alternate embodiment, the vertical wall 200 can be poured monolithically with the footing 340 and slab 320 such that the vertical wall 200 and footing 340 are one piece. Pouring the pieces together saves time in construction. Additionally, depending on the conditions, a waterproofing additive may be added to the vertical wall 200 such that it is impervious to water.

If it is determined that the soil 455 where the foundation 300 and structure 400 are being built has a swell potential greater than 2%, a liner 500 is placed on the outside 230 of the vertical wall 200. The liner 500 provides slippage of the vertical wall 200 in the soil 455 thereby eliminating friction that could cause the entire foundation 300 to move, thus causing damage to the structure 400. It is preferred that the liner 500 is made of high density polyethylene with a thickness of 15-40 millimeters, but any material with similar properties can be used.

The embodiment in FIG. 3 shows a foundation 300 used for structures 400 built at elevations between 3,000 feet and 8,000 feet. In this embodiment, the foundation 300 includes a slab 320, a footing 340, and a stem 330. The stem 330 is the structural piece between the slab 320 and the footing 340. In this embodiment, the depth of the slab 320, stem 330, and the footing 340 below finished grade, or soil level 450, is dependent on the elevation at which the structure 400 is being constructed. Specifically, at elevations of 3,000 to 5,000 feet, the depth below soil level 450 is 18 inches; at elevations of 5,000 to 7,000 feet, the depth below soil level 450 is 24 inches; and for elevations of 7,000 to 8,000 feet, the depth below soil level 450 is 36 inches. Because the vertical wall 200 contacts the underside 342 of the footing 340, these depths are also the depths at which the top 210 of the vertical wall 200 is below the soil surface 450.

The vertical wall 200 extends a distance below the footing 340 such that moisture is prevented from migrating beyond the vertical wall 200 into the zone of influence 350 under the foundation 300. In the preferred embodiment shown in FIG. 3, the vertical wall 200 extends a minimum of 3 feet 6 inches from the top 210 of the vertical wall 200 that contacts the underside 342 of the footing 340 to the bottom 220 of the vertical wall 200. This means that the bottom 220 of the vertical wall 200 is a depth of 4 feet 6 inches below the soil surface 450. This total depth depends, however, on the depth of the slab 320, stem 330, and footing 340 below the soil surface 450 as explained above. Depending on the elevation at which the structure 400 is being built, the total depth of the vertical wall 200 will vary. It is preferred that the vertical wall 200 is 4 inches wide.

To create the foundation 300 shown in FIG. 3, the area where the footing 340 will be poured is first excavated. A trencher is then used to dig a 4 inch wide excavation in line with the outer edge 343 of the footing 340 a minimum of 3 feet 6 inches below the footing 340 as described above. This 3 foot 6 inch depth can vary, however, depending on the exact make up of the soil 455. The trenched area is then cleaned and the 4 inch wide excavation is filled with concrete to create the vertical wall 200. Preferably, the excavation is filled with a ½ sack mix of concrete. Alternatively, however, the excavation could be filled with a grout mix. In this embodiment, no additional steel reinforcement is needed because, as stated above, the vertical wall 200 is not part of the structural foundation 300, but rather an appurtenance to the foundation 300. As such, the vertical wall 200 does not support the structure 400 so no reinforcement is needed. Once the vertical wall 200 is poured, the footing 340, stem 330, and slab 320 are then poured with the proper steel reinforcements and concrete. In an alternate embodiment, the vertical wall 200 can be poured monolithically with the footing 340 such that the footing 340 and vertical wall 200 are one piece. Pouring the pieces together saves time in construction. Additionally, depending on the conditions, a waterproofing additive may be added to the vertical wall 200 making it impervious to water.

If it is determined that the soil 455 where the foundation 300 and structure 400 are being built has a swell potential greater than 2%, a liner 500 is placed on the outside 230 of the vertical wall 200. The liner 500 provides slippage of the vertical wall 200 in the soil 455 thereby eliminating friction that could cause the entire foundation 300 to move, thus causing damage to the structure 400. It is preferred that the liner 500 is made of high density polyethylene with a thickness of 15-40 millimeters, but any material with similar properties can be used.

Figure 2:
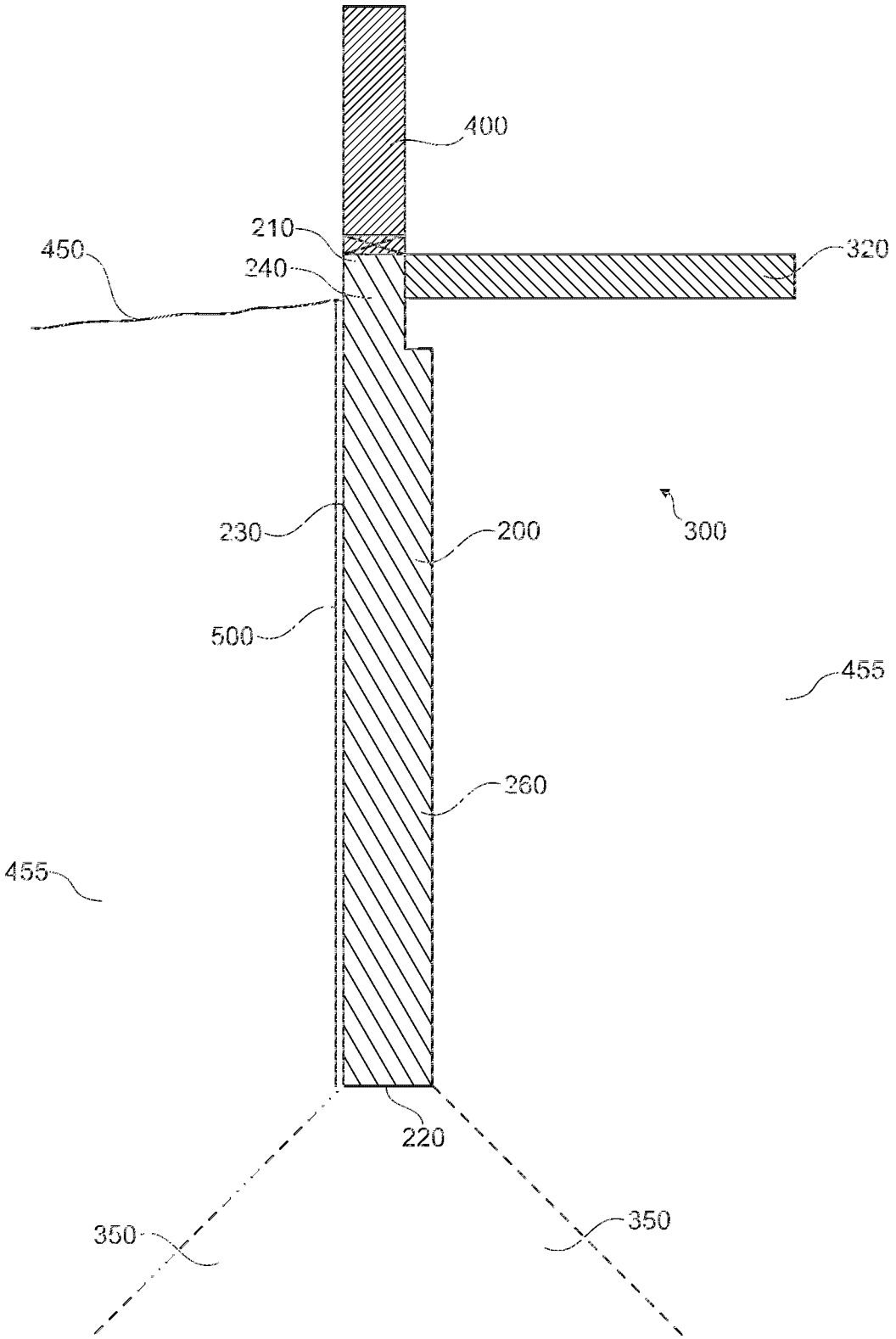
FIG. 2 shows a preferred embodiment of the invention where the vertical wall is part of the structural foundation and is located against and flush with the top of the slab.
Figure 4:
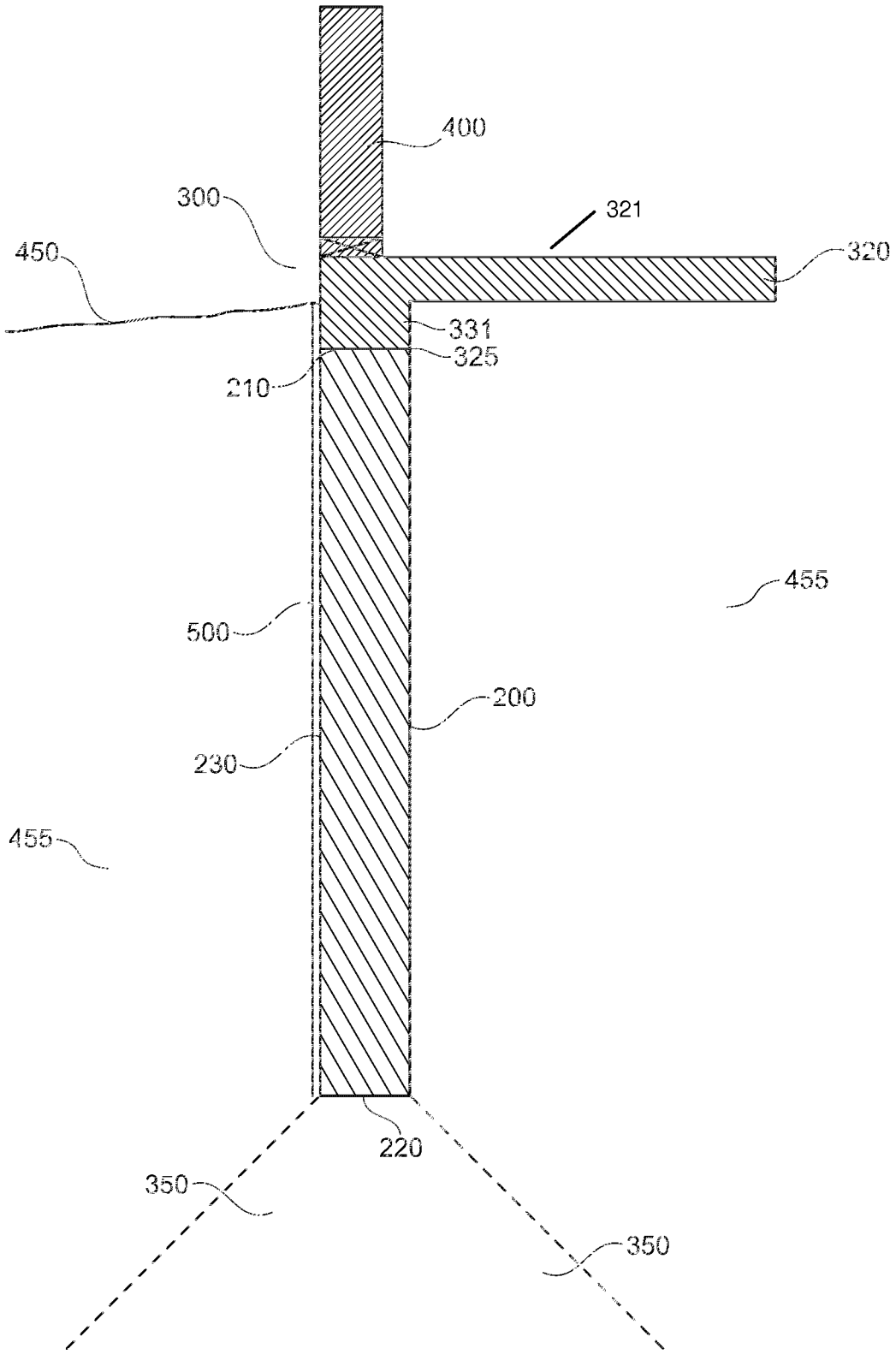
FIG. 4 shows a preferred embodiment of the invention where the vertical wall is part of the structural foundation and is located below the slab.

FIGS. 2 and 4 show an embodiment of the current invention where the vertical wall 200 is a structural element of the foundation 300. More specifically, FIG. 2 shows a preferred embodiment where the vertical wall 200 comes out of the soil surface 450 and is poured up against and flush with the top of the slab 320. The preferred embodiment shown in FIG. 4 depicts the vertical wall 200 on the underside 325 of the slab 320.

The embodiment in FIG. 2 shows a foundation 300 that includes a slab 320 and a vertical wall 200. In this embodiment, the vertical wall 200 acts as the footing 340 while at the same time preventing moisture from migrating beyond the vertical wall 200 into the zone of influence 350. The vertical wall 200 includes a top portion 240 and a bottom portion 260. The top portion 240 of the vertical wall 200 extends 12 inches in height and is formed to accommodate the final vertical wall 200 thickness. This thickness of the vertical wall 200 is preferably 8 inches, but can be thicker by widening the vertical wall 200 depending on the conditions. The bottom portion 260 of the vertical wall 200 starts 12 inches below the top 210 of the vertical wall 200 and extends a minimum depth of 4 feet 6 inches to the bottom 220 of the vertical wall 200 in order to prevent moisture from migrating beyond the vertical wall 200 into the zone of influence 350.

To create the foundation 300 shown in the preferred embodiment of FIG. 2, a trencher is used to dig an 8 inch wide excavation 4 feet 6 inches below the soil surface 450 or as desirable or required by code. The trenched area is cleaned and the excavation is filled with concrete to create the vertical wall 200. It is preferred that the concrete is normal 2500 psi concrete. Steel reinforcements are included in the vertical wall 200 along with vertical bars. The reinforcements are required because the vertical wall 200 is part of the structural foundation of the structure 400. The slab 320 is then poured up against and flush with the top 210 of the vertical wall 200 as shown in FIG. 2. In an alternate embodiment, the vertical wall 200 can be poured monolithically with the slab 320 such that the vertical wall 200 and slab 320 are one piece. Additionally, depending on the conditions, a waterproofing additive may be added to the vertical wall 200 such that it is impervious to water.

If it is determined that the soil 455 where the foundation 300 and structure 400 are being built has a swell potential greater than 2%, a liner 500 is placed on the outside 230 of the vertical wall 200. The liner 500 provides slippage of the vertical wall 200 in the soil 455 thereby eliminating friction that could cause the entire foundation 300 to move, thus causing damage to the structure 400. It is preferred that the liner 500 is made of high density polyethylene with a thickness of 15-40 millimeters, but any material with similar properties can be used.

The embodiment in FIG. 4 shows a foundation 300 that includes a turndown slab 320 and a vertical wall 200. In this embodiment, the vertical wall 200 acts as the footing 340 while at the same time preventing moisture from migrating beyond the vertical wall 200 into the zone of influence 350 under the foundation 300. The vertical wall 200 includes a top 210 and a bottom 220. The top 210 of the vertical wall 200 contacts the underside 325 of the turn down slab 320 10 inches below the topside 321 of the slab 320. Therefore, it is preferred that the top 210 of the vertical wall 200 starts 10 inches below the topside 321 of the slab 320 and extends a depth of 4 feet 6 inches to the bottom 220 of the vertical wall 200 in order to prevent moisture from migrating beyond the vertical wall 200 through the soil 455 into the zone of influence 350 under the foundation 300. In this embodiment, it is preferred that the vertical wall is 8 inches wide.

To create the foundation in the preferred embodiment shown in FIG. 4, a trencher is used to dig an 8 inch wide excavation 4 feet 6 inches below the soil surface 450 or as desirable or required by code. The trenched area is cleaned and the excavation is filled with concrete to create the vertical wall 200. It is preferred that the concrete is normal 2500 psi concrete. Steel reinforcements are included in the vertical wall 200 along with vertical bars. The reinforcements are required because the vertical wall 200 is part of the structural foundation of the structure 400. The outer edge 323 of the slab 320 is formed to accommodate the slab 320 thickness and the small portion of the stem wall 331 required to bring the slab 320 to finished floor elevation. Additionally, depending on the conditions, a waterproofing additive may be added to the vertical wall 200 such that it is impervious to water.

If it is determined that the soil 455 where the foundation 300 and structure 400 are being built has a swell potential greater than 2%, a liner 500 is placed on the outside 230 of the vertical wall 200. The liner 500 provides slippage of the vertical wall 200 in the soil 455 thereby eliminating friction that could cause the entire foundation 300 to move, thus causing damage to the structure 400. It is preferred that the liner 500 is made of high density polyethylene with a thickness of 15-40 millimeters, but any material with similar properties can be used.

The preferred embodiment of the invention is described in the Description of Preferred Embodiments. While these descriptions directly describe the one embodiment, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A structural foundation for use in expansive or other soil comprising:

a. a foundational element wherein the foundational element further comprises:

i. a vertical wall, wherein said vertical wall further comprises:

1. a top;
2. a bottom; and
3. an outside edge;

ii. a slab on a soil surface, wherein the slab further comprises an outer edge;

b. wherein the top of the vertical wall contacts the slab;

c. wherein the outside edge of the vertical wall faces away from the slab;

d. wherein the outside edge of the vertical wall is positioned underneath the slab such that the outside edge of the vertical wall and the outer edge of the slab fall within a vertical plane; and e. wherein the bottom of the vertical wall extends a distance below the slab on the soil surface and prevents moisture from migrating beyond the vertical wall under the foundational element.

2. The structural foundation of claim 1 wherein the slab further comprises a topside wherein the top of the vertical wall extends out of the soil surface and the top of the vertical wall is level with the topside of the slab.

3. The structural foundation of claim 1 wherein the slab further comprises an underside wherein the top of the vertical wall contacts the underside of the slab.

4. The structural foundation of claim 1 wherein the vertical wall is comprised of concrete.

5. The structural foundation of claim 1 wherein the vertical wall further comprises steel reinforcements.

6. The structural foundation of claim 1 wherein the vertical wall further comprises fibers.

7. The structural foundation of claim 1 wherein the vertical wall further comprises waterproofing additives such that the vertical wall is impervious to water.

8. The structural foundation of claim 1 wherein the vertical wall further comprises a liner on its outside edge.

9. The structural foundation of claim 1 wherein the vertical wall and the slab are one monolithic piece.

10. A foundation for use in expansive or other soil comprising:

a. a vertical wall, wherein said vertical wall further comprises:
   i. a top;
   ii. a bottom; and
   iii. an outside edge;

b. a foundation wherein the foundation further comprises:
   i. a slab on a soil surface, wherein the slab further comprises:
      1. a topside;
      2. an underside; and
      3. an outer edge;
   ii. a footing below the soil surface, wherein the footing further comprises:
      1. a topside;
      2. an underside; and
      3. an outer edge;

c. wherein the underside of the slab contacts the topside of the footing creating the foundation that supports a structure built on the topside of the slab;

d. wherein the top of the vertical wall contacts the underside of the footing;

e. wherein the outside edge of the vertical wall, the outer edge of the slab, and the outer edge of the footing fall within a vertical plane; and f. wherein the bottom of the vertical wall extends a distance below the soil surface and prevents moisture from migrating beyond the vertical wall under the foundation.

11. The foundation of claim 10 wherein the vertical wall is poured integral to the footing.

12. The foundation of claim 10 wherein the foundation further comprises a stem.

13. The foundation of claim 10 wherein the vertical wall is comprised of concrete.

14. The foundation of claim 10 wherein the vertical wall is comprised of grout mix.

15. The foundation of claim 10 wherein the vertical wall further comprises waterproofing additives such that the vertical wall is impervious to water.

16. The foundation of claim 10 wherein the vertical wall further comprises a liner on its outside edge.

17. The foundation of claim 10 wherein the vertical wall and foundation are one monolithic piece.

18. The foundation of claim 10 wherein the footing and slab are one monolithic piece.

19. A method of creating a foundation for use in expansive or other soil comprising the steps of:

a. excavating an area where a foundation will be poured wherein the foundation further comprises;
   i. a slab on a soil surface wherein the slab further comprises an outer edge; and
   ii. a footing below the soil surface wherein the footing further comprises an outer edge;

b. digging an excavation in line with the outer edge of the footing a distance below the footing where a vertical wall will be poured wherein the vertical wall further comprises a top and a bottom and an outside edge wherein the outside edge faces away from the slab;

c. cleaning the excavation for the vertical wall;

d. pouring the vertical wall wherein the outside edge of the vertical wall is positioned underneath the slab such that the outside edge of the vertical wall, the outer edge of the slab, and the outer edge of the footing fall within a vertical plane and the top of the vertical wall contacts the footing and the bottom of the vertical wall extends a distance below the soil surface and prevents moisture from migrating beyond the vertical wall under the foundation.

20. The method of claim 19 wherein the vertical wall is concrete.

21. The method of claim 19 wherein the vertical wall is a grout mix.

22. The method of claim 19 further comprising the step of adding a waterproofing additive to the vertical wall such that it is impervious to water.

23. The method of claim 19 wherein the vertical wall further comprises a liner on its outside edge.

24. A method of creating a structural foundation for use in expansive or other soil comprising the steps of:

a. digging an excavation below a soil surface to create a vertical wall wherein the vertical wall further comprises a top and a bottom and an outside edge;

b. cleaning the excavation for the vertical wall;

c. filling the cleaned excavation with a material to create the vertical wall wherein the outside edge of the vertical wall, the outer edge of the slab and the outer edge of the footing fall within a vertical plane and the top of the vertical wall contacts the footing and the bottom of the vertical wall extends a distance below the soil surface and prevents moisture from migrating beyond the vertical wall under the foundation and supports a structure.

25. The method of claim 24 wherein the material used to create the vertical wall is concrete.

26. The method of claim 24 further comprising the step of adding a waterproofing additive to the vertical wall such that it is impervious to water.

27. The method of claim 24 wherein the vertical wall further comprises a liner on its outside edge.

* * * * *